United States Patent [19]

Bogese, II

[11] Patent Number: 4,917,628

[45] Date of Patent: Apr. 17, 1990

[54] MODULAR PLUG FOR VARIABLY DEFORMING CABLE TERMINATED THEREIN

[75] Inventor: Stephen B. Bogese, II, Salem, Va.

[73] Assignee: Virginia Patent Development Corp., Roanoke, Va.

[21] Appl. No.: 298,871

[22] Filed: Jan. 17, 1989

Related U.S. Application Data

[60] Continuation of Ser. No. 170,636, Mar. 16, 1988, abandoned, which is a continuation of Ser. No. 65,674, Jun. 22, 1987, abandoned, which is a continuation of Ser. No. 912,179, Sep. 26, 1986, abandoned, which is a continuation of Ser. No. 815,193, Dec. 26, 1985, abandoned, which is a continuation of Ser. No. 604,229, Apr. 26, 1984, abandoned, which is a division of Ser. No. 246,165, Mar. 23, 1981, Pat. No. 4,461,923.

[51] Int. Cl.[4] ..... H01R 4/24

[52] U.S. Cl. ..... 439/391; 439/449

[58] Field of Search ..... 439/389–426, 439/449

[56] References Cited

U.S. PATENT DOCUMENTS

| | | | |
|---|---|---|---|
| 3,954,320 | 5/1976 | Hardesty | 339/103 M |
| 4,054,350 | 10/1977 | Hardesty | 339/99 R |
| 4,160,575 | 7/1979 | Schraut | 339/103 M |
| 4,195,899 | 4/1980 | Radloff et al. | 339/103 M |
| 4,607,905 | 8/1986 | Vaden | 339/176 M |

*Primary Examiner*—Joseph H. MacGlynn

*Attorney, Agent, or Firm*—Saidman, Sterne, Kessler & Goldstein

[57] ABSTRACT

A modular plug terminates a multi-conductor cable therein. The modular plug includes a locking bar hingedly attached to the housing and movable from a position outside the cable-receiving opening to a position inside the opening for compressibly holding the cable therein. A plurality of spaced surfaces are formed on the locking bar to define a plurality of different positions of the locking bar in the opening, whereby the cable may be selectively and controllaby deformed according to the position of the locking bar.

16 Claims, 2 Drawing Sheets

FIG. 1
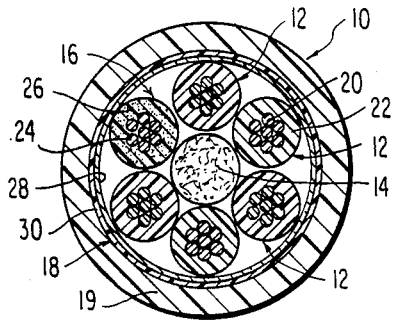
FIG. 2
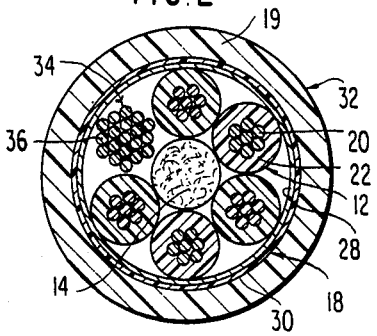
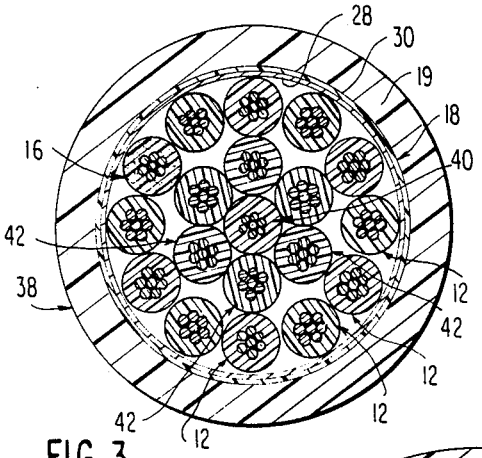
FIG. 3
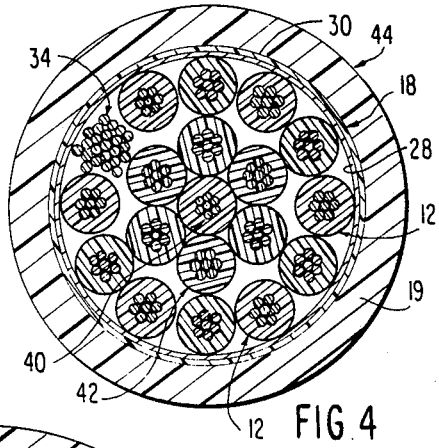
FIG. 4
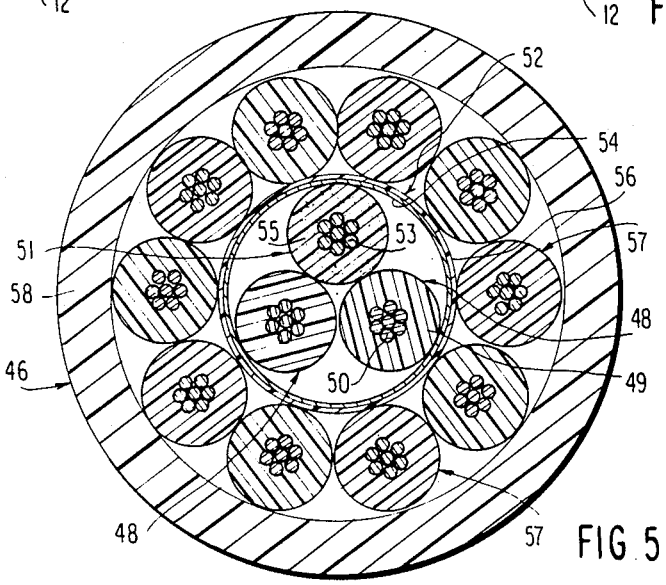
FIG. 5

MODULAR PLUG FOR VARIABLY DEFORMING CABLE TERMINATED THEREIN

This application is a continuation of application Ser. No. 170,656, filed Mar. 16, 1988, which is a continuation of Ser. No. 065,674, filed June 22, 1987, now abandoned, which is a continuation of application Ser. No. 912,179, filed Sept. 26, 1986, now abandoned, which is a continuation of Ser. No. 815,193, filed Dec. 26, 1985, now abandoned, which is a continuation of Ser. No. 604,229, filed Apr. 26, 1984, now abandoned, which is a division of Ser. No. 246,165, filed Mar. 23, 1981, now U.S. Pat. No. 4,461,923.

BACKGROUND OF THE INVENTION

1. Field of the Invention

This invention relates to flexible shielded or coaxial cables and miniature electrical connectors adapted to receive such cables, and especially to such cable and connector combinations which are adapted to provide excellent conductivity characteristics between the shield of the cable and a terminal in which the miniature connector is received.

2. Discussion of Related Art

Miniature modular connectors have gained great popularity in recent years, especially in communications applications. Cables which terminate in miniature connectors can provide a relatively inexpensive yet highly effective means of interconnecting various components of a modular telephone system. For instance, a telephone base which includes the dialing and the ringing apparatus can easily be attached to a handset by use of a cord terminated by miniature connectors such as a modular plug and modular jack. Miniature connectors have also been found to be very useful in interconnecting the components of computer operated telecommunication terminals and for attaching such terminals through modems to a main communication network.

In order to preserve the integrity of information transmitted through communication data links, it is often necessary to utilize shielded cable. It would be desirable to be able to terminate a shielded cable in a miniature modular connector in order that the advantages of such miniature connectors can be gained by the users of shielded cable. However, certain problems exist with respect to termination of shielded cables which are not present with unshielded cables. For instance, excellent continuity must be maintained from the shield to the terminals of a miniature connector. Also, the shield itself must be suitably adapted to be easily received within a miniature connector. Furthermore, the overall size of the shielded cable must be kept sufficiently small so that the size of the miniature connector itself may also remain small.

To date, little work has been done by others to provide shielded cable and miniature modular connector combinations which are able to perform well at a minimum expense. However, various coaxial cable constructions have been suggested.

For example, U.S. Pat. No. 3,291,891 issued Dec. 13, 1966 to Sharp shows a shielded electric cable which includes a plurality of insulated and uninsulated conductors having the same outer diameter disposed circumferentially along the surface of a center conductor. The conductors are wrapped in a shield which comprises an elongated strip of metal foil which is insulated on one side by a film of suitable material such as polyethylene terephthate resin or the like.

U.S. Pat. No. 3,644,659 issued Feb. 22, 1972 to Campbell shows a cable construction comprising a plurality of twisted pair insulated conductors disposed around a plurality of filler strings. A shield layer is disposed over the twisted pair conductors and is grounded through a drain wire, such as a multi-strand wire which is disposed in the space between two neighboring ones of the twisted pair conductors.

U.S. Pat. No. 3,816,644 issued June 11, 1974 to Giffel et al shows a low noise flexible cord comprising a plurality of insulated conductors which can be disposed around a central core. Some of the conductors are shielded and some conductors are unshielded. The shielded conductors are disposed adjacent uninsulated strands which serve as grounding wires.

Furthermore, various connectors have been suggested in the past. For instance, U.S. Pat. No. 4,054,350 to Hardesty and U.S. Pat. No. 4,160,575 to Schraut show miniature connectors adapted for use with round cable constructions. As described therein, a miniature modular plug is characterized by a unipartite or one-piece rigid dielectric housing having a free end for insertion into a mating modular jack, a movable locking tab extending angularly rearwardly from the free end of the housing and adapted to mate with a tab-receiving latch in the modular jack, a cable input end for receiving a multi-conductor cable having an outer jacket, a terminal receiving side having a plurality of slots for receiving substantially planar contact terminals having insulation-piercing tangs at the lower portion thereof for terminating the conductors of the cable and an upper portion for making electrical contact with the spring contact members of the mating modular jack, and a cable receiving cavity defined by first and second side walls and top and bottom walls for receiving the multi-conductor cable. The Hardesty connector maintains the round cable in a pressurized engagement within an opening by the use of an anchoring member which is hinged to the connector and pivots into the opening. The Schraut connector uses an anchoring member which is separate from the connector and slides into an opening through one wall of the connector.

U.S. Pat. No. 3,751,579 to Nojiri and U.S. Pat. No. 4,195,899 to Radloff et al show strain relief collars for use with electrical cables. The Nojiri collar is adapted for connection to a housing. Pressure of the collar against a cable can be adjusted by selective insertion of a retainer into a bushing. The retainer contains a plurality of ridges which coact with complimentary ridges on the bushing. The collar used in the Radloff et al device is adapted for connection to a round multi-conductor cable and contains an arcuate section on a fastener clamp for engagement with the round cable. Holding pressure against the cable can be adjusted by selective insertion of the fastener into a base.

OBJECTS OF THE INVENTION

A primary object of the present invention is to provide a shielded cable which can be easily and rapidly terminated in a miniature modular connector.

Another object of the present invention is to provide a shielded cable having a ground conductor which is of sufficient size to remain in intimate contact with the cable shield.

A further object of the present invention is to provide a shielded cable and connector combination wherein the connector includes a mechanical anchoring device capable of producing a pressure connection with the cable such that a consistent conductivity is maintained from the cable shield to the ground conductor in the cable.

An additional object of the present invention is to provide a shielded cable and miniature connector combination wherein the pressurized connection between the cable and connector can be varied to provide selective cable deformations resulting in selective conductivity from the cable shield to the ground conductor contained within the cable.

A still further object of the present invention is to provide a shielded cable wherein the ground conductor is of a size which is capable of accurate location within a miniature connector for enabling rapid, positive termination of the connector.

SUMMARY OF THE INVENTION

In accordance with the above and other objects, the present invention comprises a multi-conductor round cable construction having at least one layer containing a plurality of insulated conductors. The insulated conductors have approximately equal outside diameters and are surrounded by a flexible electrically conductive shield for isolating the conductors from external electromagnetic interference. A drain in the form of a single uninsulated conductor is contained in the layer of conductors. The single uninsulated conductor has an outside diameter approximately equal to the outside diameter of the insulated conductors and is disposed in intimate contact with the shield for providing electrical conductivity between the shield and the drain. An outer jacket surrounds the shield and adds strength to the cable.

In accordance with other features of the invention, the uninsulated conductor can be in the form of a metallic conductor having a semi-conductive coating, or alternatively can be in the form of a multi-strand wire capable of use in applications where electrostatic charges build to high voltages.

The shielding of the cable is achieved by a layer of metallic foil laminated to a layer of synthetic resin. The synthetic resin can be in the form of a material sold under the trademark Mylar ®.

The cable also contains a core which can comprise a non-electrically conductive multi-filament fiber which allows the insulated and non-insulated conductors of the cable to be seated firmly. Alternatively, the core can contain a plurality of additional insulated conductors disposed in layers. In the case where a plurality of layers are used, the shield of the invention can surround an inner layer of the plurality with the uninsulated conductor being disposed in the layer immediately below and adjacent to the shield.

The cable is especially adapted for use with the connector of the present invention. The connector comprises a housing formed of a dielectric material which includes a cable receiving opening for accepting the cable. A cable locking device in the form of a mechanical anchor is formed in the housing for compressibly holding the cable in the opening and causing deformation of a portion of the cable. The deformation produces consistent conductivity between the uninsulated ground conductor and the shield.

The cable locking device includes an apparatus for producing a variable pressure for compressibly holding the cable in the opening. The variable pressure produces controllable deformation of the cable. The cable locking device is in the form of a solid locking bar hingedly attached to the housing and movable from a position outside the opening to a position inside the opening. The apparatus for producing a variable pressure comprises a plurality of spaced surfaces formed on the locking bar. Each of the spaced surfaces is adapted to selectively engage a shoulder formed on the housing for holding the locking bar at a different position within the opening.

BRIEF DESCRIPTION OF THE DRAWINGS

The foregoing together with other objects and advantages of the invention which will become subsequently apparent reside in the details of construction and operation as more fully hereinafter described and claimed, reference being had to the accompanying drawings forming a part hereof, wherein like numerals represent like parts throughout, and wherein FIG. 1 is a transverse sectional view of a first embodiment of the cable of the present invention;

FIG. 2 is a transverse sectional view of a second embodiment of the cable of the present invention;

FIG. 3 is a transverse sectional view of a third embodiment of the cable of the present invention;

FIG. 4 is a transverse sectional view of a fourth embodiment of the cable of the present invention;

FIG. 5 is a transverse sectional view of a fifth embodiment of the cable of the present invention;

DETAILED DESCRIPTION OF THE PREFERRED EMBODIMENTS

Figure 6:
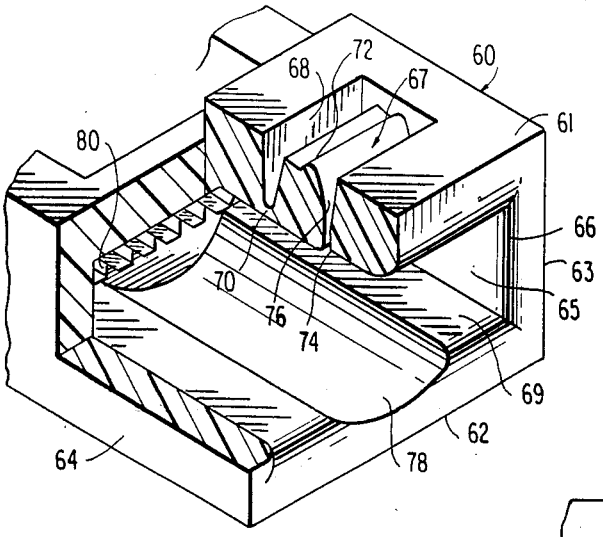
FIG. 6 is a perspective, part sectional view of one embodiment of the connector of the present invention.

Now with reference to the drawings, a cable and connector built according to the principles and concepts of the present invention will be set forth in detail. In FIG. 1, a first embodiment of the cable of the present invention is generally referred to by the reference numeral 10. Cable 10 includes a plurality of insulated conductors 12 and an uninsulated conductor 16, all preferably disposed in a single layer about a central core 14. A shield 18 is wrapped around conductors 12 and 16 to protect the conductors from spurious electromagnetic interference. A jacket 19 is disposed over shield 18.

Conductors 12 are of conventional design and include one or a plurality of inner metallic wires 20 with an insulation covering 22 extruded or otherwise formed thereover. All of the conductors 12 are approximately equal in outside diameter so that the spacing between core 14 and shield 18 is equal around the entire cable thus giving the cable a round configuration in cross-section, a shown. The uninsulated conductor 16 also has the same outside diameter as insulated conductors 12. The diameter of conductor 16 is maintained equal to that of conductors 12 in order to maintain the circular cable configuration and also to insure constant, intimate contact between uninsulated conductor 16 and shield 18 in order that the conductor 16 can act as a drain or ground wire for the shield. The conductor 16 itself may be formed from one or a plurality of metallic wires 24 disposed in a semiconductive cover 26 which can be any suitable semiconducting material such as carbon-loaded polymeric plastic substances now so employed.

Core 14 can be comprised of, for example, any multi-filament fiber which is sufficiently firm to support and maintain conductors 12 and 16 in fixed position. The conductors 12 and 16 are spaced evenly around the circumference of core 14 in such a manner that they all contact the inner surface of shield 18. Shield 18 preferably comprises a metallic conductive foil layer 28 which contacts the conductors 12 and 16, and an outer plastic laminate 30. The foil layer 28 faces inwardly in order that electromagnetic interference received thereby can be transmitted to uninsulated conductor 16 as is apparent to one of ordinary skill in the art. The plastic laminate 30 faces outwardly and supports the foil layer to provide strength thereto. The plastic laminate can be of any known synthetic material, such as polyethylene terephthate resin, commonly sold under the trademark Mylar®. The plastic laminate 30 and foil layer 28 are capable of flexing with the cable without damage to the shield. However, additional structural support is also provided by the outer jacket 19 which encases the shield. Jacket 19 preferably comprises a thermoplastic material such as polyvinylchloride. However, other suitable materials may also be employed.

A second embodiment of the cable is shown in FIG. 2 and is indicated generally by the reference numeral 32. Cable 32 is similar to cable 10 except that cable 32 is adapted for applications where electrostatic charges may build up to high voltages, such as 10,000 volts. Such high voltages must be drained off rapidly from the shield 18 in order to avoid arcing into the signal bearing insulated conductors 12. Accordingly, an uninsulated ground conductor 34 is utilized which has higher current carrying capacity than the semiconductive conductor 16 of cable 10. Uninsulated ground conductor 34 is composed of a plurality of metallic wires 36. Wires 36 are twised together to form a relatively flexible, large gauge conductor. Conductor 34 is formed with a cross-sectional outside dimension approximately equal to that of insulated conductors 12 so that maximum contact will be made with shield 18 without deforming the round configuration of cable 32. The exact number of wires 36 to be used in conductor 34 will, of course, vary according to the specific application in which cable 32 is to be employed.

A third embodiment of the invention is shown in FIG. 3 and is generally indicated by the reference numeral 38. Cable 38 is similar to cable 10 of FIG. 1 except that in place of core 14 of cable 10, a central insulated conductor 40 and a first layer of insulated conductors 42 are employed. The second layer of conductors 12 of cable 38 contains an uninsulated ground conductor 16 which contacts the foil layer 28 of shield 18. All of the insulated conductors 40, 42 and 12, as well as uninsulated conductor 16, have approximately the same outside diameter in order that maximum contact can be made between uninsulated conductor 16 and foil layer 28. The advantage of cable 38 over cable 10 is that cable 38 is clearly capable of transmitting a larger number of signals.

FIG. 4 shows a fourth embodiment of the cable of the present invention, generally referred to by the reference numeral 44. Cable 44 is similar to cable 38 except that in place of a semiconductor uninsulated ground conductor 16, a stranded multi-wire conductor 34 is used to adapt the cable for utilization in high voltage environments. Again, all conductors of cable 44 including ground conductor 34 have the same outside diameter to insure maximum contact and therefore conductivity between foil layer 28 of shield 18 and uninsulated conductor 34.

A fifth embodiment of the cable is shown in FIG. 5 and is generally indicated by reference numeral 46. Cable 46 is a two layer round cable having a shield 52 which covers only the inner layer consisting of two insulated conductors 48 and one uninsulated conductor 51. Conductors 48 are of the standard multi-wire insulated type having metal wires 50 surrounded by a plastic insulation 49. The uninsulated conductor 51 either can be a semiconductor having metal wires 53 covered by semiconductive material 55 or can be of the multi-filament metal conductor type as shown at 34 in FIGS. 2 and 4. The shield 52 is constructed with an inner foil layer 54 which is in intimate contact with uninsulated conductor 51. Inner foil layer 54 is laminated to plastic laminate 56, the outer surface of which supports the second, outer layer of cable 46.

The second outer layer comprises a plurality of insulated conductors 57 built in a manner similar to conductors 48. Conductors 57 are spaced evenly about the shielding 52 to form a round cable configuration. The second, outer layer of conductors is surrounded by outer jacket 58 which can be of standard PVC or the like.

Cable 46 is particularly useful in applications where some, but not all conductors require shielding. By selectively shielding only the number of conductors required, both the overall size and cost of production of the cable can be reduced. Naturally, additional layers of conductors can be added as desired either beneath or above the shield 52. The uninsulated ground conductor 51 would always be disposed in the conductor layer immediately beneath and adjacent to shield 52 to insure proper grounding termination of the inner foil layer 54 of the shield.

Now with reference to FIG. 6, a first embodiment of a miniature modular connector (which may be used to terminate any of the cables shown in FIGS. 1–5, or other cable constructions) will be described in detail. The miniature connector is generally referred to by reference numeral 60 and comprises a housing having top wall 61, bottom wall 62 and side walls 63, 64. Walls 61–64 define an opening 65 which is adapted to receive one of the cables of the invention. It will be noted that the inner edge of each wall is curved as shown at 66 to facilitate insertion of the cable into opening 65. It will also be noted that opening 65 is elongated in the transverse direction in order to accommodate the final deformed configuration of the cable as will be discussed hereinafter.

The connector 60 contains a mechanical anchoring system comprising a locking bar 67 which is disposed in an opening 68 formed in top wall 61. Bar 67 is hingedly attached at 70 to wall 61 for movement from a position in opening 68 to a position in opening 65. Locking bar 67 contains an offset locking surface 72 formed on one side thereof. Surface 72 engages a shoulder 74 formed on the lower portion of opening 68 to hold locking bar 67 within opening 65 in a conventional manner. When the locking bar 67 is forced into opening 65, gripping surface 76 engages the cable which is disposed therein and compressibly holds the cable within the opening against wall 62. Accordingly, a round cable which is compressed by locking bar 67 takes on an oval shape which is transversely elongated to fit within opening 65. This transverse elongation serves to align certain of the conductors contained within the cable with conductor receiving channels 80 that are horizontally disposed at one end of housing 60 so that individual conductors of the cable will easily be received therein with little or no strain being placed on the conductors. Further, the compressional force generated by locking bar 67 serves to produce a more consistent conductive contact between, for instance, uninsulated conductor 16 shown in FIG. 1 and foil surface 28 of shield 18. Clearly, a cable disposed in opening 65 is forced by locking bar 67 against the inner surface 69 of bottom wall 62. An arcuate recess 78 preferably extends longitudinally of opening 65 in wall 62. The depth of recess 78 determines the extent of deformation of a cable disposed therein and thus determines the extent of conductivity generated between the foil layer of the cable shield and the associated uninsulated ground conductor.

Figure 7:
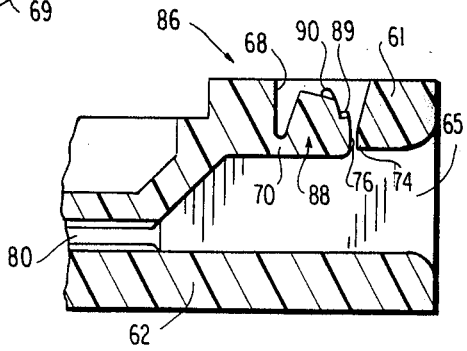
FIG. 7 is a longitudinal sectional view of a second embodiment of the connector of the present invention.

FIG. 7 shows a second embodiment of the miniature connector which is generally referred to by the reference numeral 86. Connector 86 includes a housing having the cable receiving opening 65 formed therein. In contrast to the first embodiment of FIG. 6, the inside surface 69 of lower wall 62 which partially defines opening 65 is planar. The top wall 61 contains a locking bar 88 hingedly connected at 70 to top wall 61. The locking bar 88 contains a pair of spaced, parallel locking surfaces 89 and 90 which can individually contact shoulder 74 formed on lower ridge of opening 68. The locking surfaces 89 and 90 therefore individually define two separate levels of pressurization which can be used to hold a cable in opening 65 and deform the cable. That is, at the first level of pressurization, cable locking bar 88 is in a first position on the cable within opening 65; and, at the second level of pressurization, locking bar 88 is in a second position on the cable. Accordingly, by adjusting the position of locking bar 88, the conductivity between an uninsulated ground conductor and its associated shield can easily be varied. Of course, more than two positions for locking bar 88 may be provided, if desired.

Figure 10:
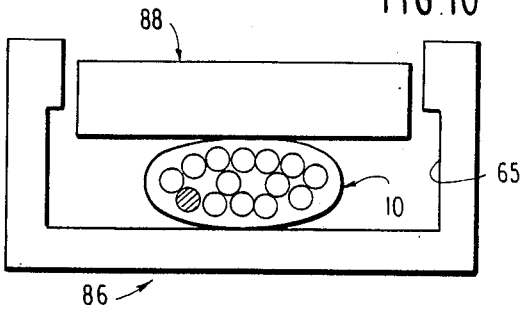
FIG. 10 is a schematic representation of the connector of FIG. 7 with its locking bar in a first locking position.
Figure 9:
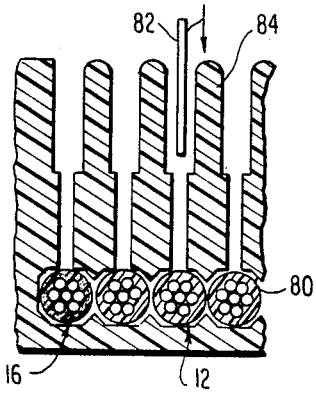
FIG. 9 is a transverse sectional view showing the conductor receiving channels of a connector containing a cable which is similar to the cable shown in FIG. 1.
Figure 11:
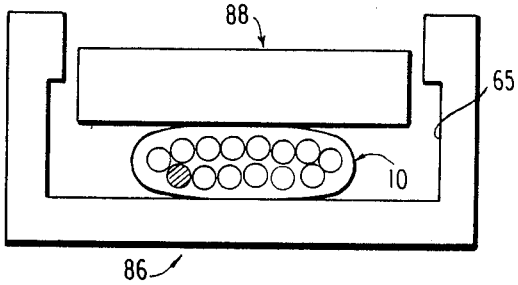
FIG. 11 is similar to FIG. 10 but illustrates the locking bar in a second locking position.

Operation of the device will now be described with respect to cable 10 in FIG. 1 and connector 86 of FIG. 7, it being understood that alternate embodiments of the invention operate similarly. Initially, when termination of cable 10 is desired, the jacket 19, shield 18 and core 14 are cut back by a sufficient amount to allow the insulated and uninsulated conductors to be inserted through opening 65 until being individually received and seated in channels 80. By use of an appropriate implement, the locking bar 88 is then forced downwardly. When surface 89 engages shoulder 74, the cable takes on a first oval shape as shown in FIG. 10. If desired, the locking bar 88 can be forced to swing downwardly to a second position defined by locking surface 90 to flatten cable 10 still further thereby increasing the conductivity between the grounding conductor 16 and shield 18. FIG. 11 sets forth the configuration of cable 10 when locking bar 88 is in its second position.

Once the cable is thereby firmly fixed in opening 65, the cable conductors 12 and 16 are individually terminated in channels 80 by respective contact blades 82 which slide between ribs 84 formed in the end of the housing, as is conventional. It will be noted that each of the conductors 12, 16 is of the same diameter and sufficiently large to substantially fill channels 80. Accordingly, the thin contact blades 82 will be properly aligned so as to pierce the outer insulation of conductors 12 and the semiconductive covering of conductor 16 to engage positively the inner metallic wires of the conductors. Once a contact blade 82 has been forced into each conductor, termination of the cable 10 is complete.

Figure 8:
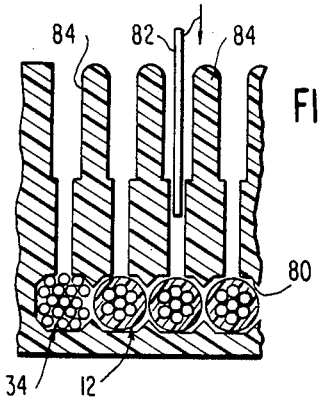
FIG. 8 is a transverse sectional view showing the conductor receiving channels of a connector containing a cable which is similar to the cable shown in FIG. 2.

FIG. 8 shows the individual conductors 12 and 34 of cable 32 (FIG. 2) disposed in cable receiving channels 80. Accordingly, it can also be seen that the overall dimension of multi-strand bare conductor 34 is important in that the conductor must be dimensioned properly to fit within the associated channel 80. The conductor must fill the channel so that it is aligned beneath the space between two adjacent ribs 84 and thus can easily be pierced by a contact blade 82 to produce efficient grounding for the shielding of the cable.

It can be understood from the foregoing that a cable and connector combination has been disclosed which provides a conductive path from the thin and very difficult to terminate foil shield of a shielded cable to a contact blade of the connector so that the shield can be easily grounded to drain electromagnetic interference. By essentially providing each cable with ground conductors which are of equal outside diameter to the insulated signal carrying conductors, and by disposing the ground conductors adjacent to the cable shield, the shield is more easily grounded. By disposing the cable in an appropriate miniature modular connector and by adjusting the pressure of the mechanical anchoring device in the connector, excellent conductivity between the grounding conductor and shield is ensured. Also, since each of the conductors, both insulated and uninsulated, is dimensioned to be slightly less in diameter than the channel receiving it, the connector contact blades are easily aligned with the center of the associated conductor so as to pierce same and positively terminate the metal wires contained therein.

The foregoing is considered as illustrative only of the principles of the invention. Further, since numerous modifications and changes will readily occur to those skilled in the art, it is not desired to limit the invention to the exact construction and operation shown and described and accordingly all suitable modifications and equivalents may be resorted to, falling within the scope of the invention.

I claim as my invention:

1. In a modular plug characterized by a unipartite rigid dielectric housing having a free end for insertion into a mating modular jack, a movable locking tab extending angularly rearwardly from the free end of the housing and adapted to mate with a tab-receiving latch in the modular jack, a cable input end having a cable-receiving opening for receiving a multi-conductor cable having an outer jacket, and a terminal receiving side having a plurality of slots for receiving substantially planar contact terminals having insulation-piercing tangs at the lower portion thereof for terminating the conductors of the cable in the opening and an upper portion for making electrical contact with the spring contact members of the mating modular jack, the improvement which comprises cable locking means formed in said housing adapted to compressibly hold the cable in said opening and to cause deformation of a portion of the cable, said cable locking means including means for producing a variable pressure for compressibly holding the cable in said opening thereby producing controllable deformation of the cable, said means for producing a variable pressure including a first level of pressurization on said cable during which said cable locking means is in a first position on said cable, and a second level of pressurization on said cable during which said cable locking means is in a second position on said cable.

2. The modular plug as set forth in claim 1, wherein said cable locking means comprises a locking bar hingedly attached to said housing and movable from a position outside said opening to a position inside said opening.

3. The modular plug as set forth in claim 2, wherein said opening includes a wall disposed opposite said locking bar, said wall including a recess formed therein for receiving said cable and defining the extent of deformation of said cable.

4. The modular plug as set forth in claim 2, wherein said means for producing a variable pressure comprises a plurality of parallel spaced surfaces formed on said locking bar, each of said surfaces being adapted to maintain said locking bar at a different position within said opening.

5. The modular plug as set forth in claim 4, wherein said housing contains a plurality of laterally aligned channels communicating with said opening for receiving individual ones of the conductors of the cable, said channels having a lateral dimension slightly larger than the respective conductor received therein.

6. The modular plug as set forth in claim 4, wherein said housing includes a shoulder formed adjacent said opening, said shoulder being in operative relation to said surfaces for selectively engaging either of said surfaces for maintaining said locking bar in different positions within said opening.

7. A modular plug, comprising:

(a) a unipartite rigid dielectric housing having a free end for insertion into a mating modular jack;

(b) a movable locking tab extending from the housing and adapted to mate with a tab-receiving latch in the modular jack;

(c) a cable input end having a cable-receiving opening for receiving a multi-conductor cable having an outer jacket;

(d) a terminal receiving side having a plurality of slots for receiving substantially planar contact terminals having insulation-piercing tangs at the lower portion thereof for terminating the conductors of the cable in the opening and an upper portion for making electrical contact with the spring contact members of the mating modular jacket; and (e) cable locking means integrally formed in said housing and adapted to compressibly hold the cable in said opening and to cause deformation of a portion of the cable;

(f) said cable locking means including means for producing a variable pressure for compressibly holding the cable in said opening thereby producing controllable deformation of the cable; and (g) said means for producing a variable pressure including a first level of pressurization on said cable during which said cable locking means is in a first position on said cable, and a second level of pressurization on said cable during which said cable locking means is in a second position on said cable.

8. The modular plug as set forth in claim 7, wherein said cable locking means comprises a locking bar hingedly attached to said housing and movable from a position outside said opening to a position inside said opening.

9. The modular plug as set forth in claim 8, wherein said opening includes a wall disposed opposite said locking bar, said wall including a recess formed therein for receiving said cable and defining the extent of deformation of said cable.

10. The modular plug as set forth in claim 8, wherein said means for producing a variable pressure comprises a plurality of spaced surfaces formed on said locking bar, each of said surfaces being adapted to maintain said locking bar at a different position within said opening.

11. The modular plug as set forth in claim 10, wherein said housing contains a plurality of laterally aligned channels communicating with said opening for receiving individual ones of the conductors of the cable, said channels having a lateral dimension slightly larger than the respective conductor received therein.

12. The modular plug as set forth in claim 10, wherein said housing includes a shoulder formed adjacent said opening, said shoulder being in operative relation to said surfaces for selectively engaging either of said surfaces for maintaining said locking bar in different positions within said opening.

13. A modular plug, comprising:

(a) a unipartite rigid dielectric housing having a free end for insertion into a mating modular jack;

(b) a movable locking tab extending from the housing and adapted to mate with a tab-receiving latch in the modular jack;

(c) a cable input end having a cable-receiving opening for receiving a multi-conductor cable having an outer jacket;

(d) a terminal receiving side having a plurality of slots for receiving substantially planar contact terminals having insulation-piercing tangs at the lower portion thereof for terminating the conductors of the cable in the opening and an upper portion for making electrical contact with the spring contact members of the mating modular jack;

(e) cable locking means integrally formed in said housing and adapted to compressibly hold the cable in said opening and to cause deformation of a portion of the cable;

(f) said cable locking means including means for producing a variable pressure for compressibly holding the cable in said opening thereby producing controllable deformation of the cable;

(g) wherein said means for producing a variable pressure includes a first level of pressurization on said cable during which said cable locking means is in a first position on said cable, and a second level of pressurization on said cable during which said cable locking means is in a second position on said cable;

(h) wherein said cable locking means comprises a locking bar hingedly attached to said housing and movable from a position outside said opening to a position inside said opening; and (i) wherein said opening includes a wall disposed opposite said locking bar for receiving said cable and defining the extent of deformation of said cable.

14. The modular plug as set forth in claim 13, wherein said means for producing a variable pressure comprises a plurality of spaced surfaces formed on said locking bar, each of said surfaces being adapted to maintain said locking bar at a different position.

15. The modular plug as set forth in claim 14, wherein said housing contains a plurality of laterally aligned channels communicating with said opening for receiving individual ones of the conductors of the cable, said channels having a lateral dimension slightly larger than the respective conductor received therein.

16. The modular plug as set forth in claim 14, wherein said housing includes a shoulder formed adjacent said opening, said shoulder being in operative relation to said surfaces for selectively engaging either of said surfaces for maintaining said locking bar in different positions within said opening.

* * * * *

UNITED STATES PATENT AND TRADEMARK OFFICE
CERTIFICATE OF CORRECTION

PATENT NO. : 4,917,628

DATED : April 17, 1990

INVENTOR(S) : Stephen B. Bogese, II

It is certified that error appears in the above-identified patent and that said Letters Patent is hereby corrected as shown below:

ON THE TITLE PAGE

The title page showing the illustrative figure should be deleted to be replaced with the attached title page.

Figure 12:
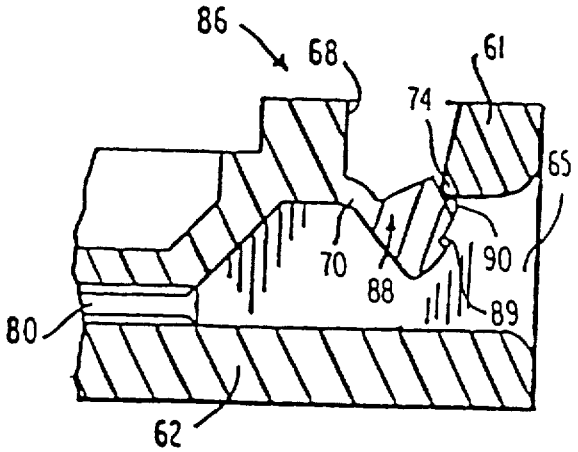
FIG. 12 is a longitudinal sectional view of the connector of FIG. 7, with its cable locking bar in the second position.

The sheet of drawing consisting of Fig. 12, should be added as shown on the attached page.

Column 5, line 1, delete "a" and insert --as-- therefor; and
line 48, delete "twised" and insert --twisted-- therefor.

Signed and Sealed this

Fourteenth Day of January, 1992

*Attest:*

HARRY F. MANBECK, JR.

*Attesting Officer* *Commissioner of Patents and Trademarks*

United States Patent [19]

Bogese, II

[11] Patent Number: 4,917,628

[45] Date of Patent: Apr. 17, 1990

[54] MODULAR PLUG FOR VARIABLY DEFORMING CABLE TERMINATED THEREIN

[75] Inventor: Stephen B. Bogese, II, Salem, Va.

[73] Assignee: Virginia Patent Development Corp., Roanoke, Va.

[21] Appl. No.: 298,871

[22] Filed: Jan. 17, 1989

Related U.S. Application Data

[60] Continuation of Ser. No. 170,636, Mar. 16, 1988, abandoned, which is a continuation of Ser. No. 65,674, Jun. 22, 1987, abandoned, which is a continuation of Ser. No. 912,179, Sep. 26, 1986, abandoned, which is a continuation of Ser. No. 815,193, Dec. 26, 1985, abandoned, which is a continuation of Ser. No. 604,229, Apr. 26, 1984, abandoned, which is a division of Ser. No. 246,165, Mar. 23, 1981, Pat. No. 4,461,923.

[51] Int. Cl.[4] ..... H01R 4/24

[52] U.S. Cl. ..... 439/391; 439/449

[58] Field of Search ..... 439/389–426, 439/449

[56] References Cited

U.S. PATENT DOCUMENTS

| | | | |
|---|---|---|---|
| 3,954,320 | 5/1976 | Hardesty | 339/103 M |
| 4,054,350 | 10/1977 | Hardesty | 339/99 R |
| 4,160,575 | 7/1979 | Schraut | 339/103 M |
| 4,195,899 | 4/1980 | Radloff et al. | 339/103 M |
| 4,607,905 | 8/1986 | Vaden | 339/176 M |

*Primary Examiner*—Joseph H. MacGlynn

*Attorney, Agent, or Firm*—Saidman, Sterne, Kessler & Goldstein

[57] ABSTRACT

A modular plug terminates a multi-conductor cable therein. The modular plug includes a locking bar hingedly attached to the housing and movable from a position outside the cable-receiving opening to a position inside the opening for compressibly holding the cable therein. A plurality of spaced surfaces are formed on the locking bar to define a plurality of different positions of the locking bar in the opening, whereby the cable may be selectively and controllaby deformed according to the position of the locking bar.

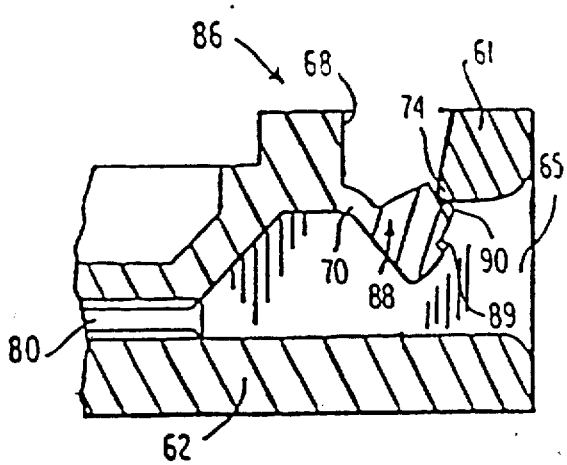

16 Claims, 2 Drawing Sheets